United States Patent [19]

Bayo

[11] Patent Number: 4,854,062

[45] Date of Patent: Aug. 8, 1989

[54] ILLUMINATED HOUSE NUMBER DEVICE

[76] Inventor: Luis E. Bayo, 211 SW. 119 Ave., Miami, Fla. 33184

[21] Appl. No.: 148,038

[22] Filed: Jan. 25, 1988

[51] Int. Cl.[4] ..... G09F 13/28

[52] U.S. Cl. ..... 40/551; 40/576

[58] Field of Search ..... 40/550, 551, 575, 576, 40/552, 622; 362/800

[56] References Cited

U.S. PATENT DOCUMENTS

| | | | |
|---|---|---|---|
| 696,775 | 4/1902 | Tripp et al. | 40/551 |
| 982,352 | 1/1911 | Diehl | 40/450 |
| 1,066,591* | 7/1913 | Ellis | 40/450 |
| 1,850,285 | 3/1932 | Miller | 40/550 |
| 2,295,188 | 9/1942 | Starnes | 40/545 |
| 2,958,969 | 11/1960 | Fazekas | 40/576 |
| 3,212,080 | 10/1965 | Gurian | 340/386 R |
| 4,709,307 | 11/1987 | Branom | 40/550 |

*Primary Examiner*—Robert P. Swiatek
*Assistant Examiner*—Cary E. Stone
*Attorney, Agent, or Firm*—J. Sanchelima

[57] ABSTRACT

A device for illuminating numbers being connected to a conventional low voltage transformer, preferably, across the contacts of a typical switch (momentary type). When the switch is closed, the short circuit bypasses the device's load (low power consumption) to activate the annunciator. The device includes a bracket assembly that slidably holds one or more number or letter assemblies. Opposite electrodes are positioned on the front of the bracket assembly in the upper and lower parts thereof and in cooperative electrical contact with the L.E.D. circuits defining those numbers or letters through contact pads disposed in opposite corners of the numeral or letter assemblies.

6 Claims, 3 Drawing Sheets

ILLUMINATED HOUSE NUMBER DEVICE

BACKGROUND OF THE INVENTION

1. Field of the Invention.

The present invention relates to illuminated house number devices.

2. Description of the Related Art.

The need for an illuminated house number or letter device that can be readily installed in a house is apparent. Many times the house number can not be readily distinguished and it could even be dangerous if the dwelling identification constitutes an emergency.

Applicant believes that the closest reference corresponds to U.S. Pat. Nos. 982,352; 1,066,591 and 2,295,188 issued to Diehl, Ellis and Starnes, respectively. However, it differs from the present invention because the letters can not be readily connected to an existing transformer for annunciators across the typical momentary normally open switch. Also, the patented devices can not be both horizontally and/or vertically disposed without substantially modifying their connecting structure. Finally, even if these patented devices were connected across the switch contacts they would draw sufficient current to constantly activate the annunciator.

In U.S. Pat. No. 3,212,080 issued to Gurian, an electroluminescent panel controlled by a doorbell switch is disclosed where a step up transformer is required to bring the voltage up to 125 volts in its secondary. This, of course, requires considerable current in its primary which in turn acts as a shunt for switch 50. To work effectively the ratio of the impedance of the annunciator to the input impedance presented by the step up transformer has to be such that the voltage drop across the annunciator when switch 50 is open is below its threshold voltage. This limits severely the power capacity of the annunciator (requiring impedance to be low) and the load of the luminescent panel (requiring impedance to be high). Also, as in the other cited patents, the panel numbers can only be placed either horizontally or vertically but can not be readily changed from one position to the other one or any other slanted position.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide an illuminated numbers device that is fed from the same power available for conventional household bells and chimes.

It is another object of this present invention to provide such a device where the numerals can be readily inserted and removed.

It is yet another object of the present invention to provide such a device that is inexpensive to manufacture and maintain while retaining its effectiveness.

It is still another object of this invention to provide such a device where the numerals or letters can be positioned in a number of predetermined angular inclinations.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
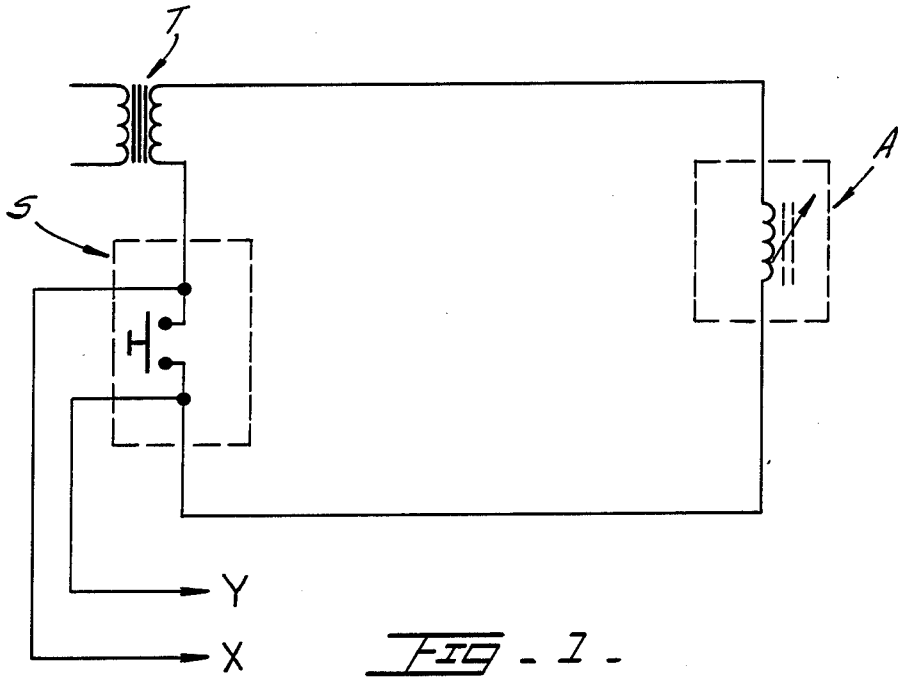
FIG. 1 represents an electrical diagram of a conventional transformer output circuit and bell or chime showing the points where the present invention is connected.
Figure 4:
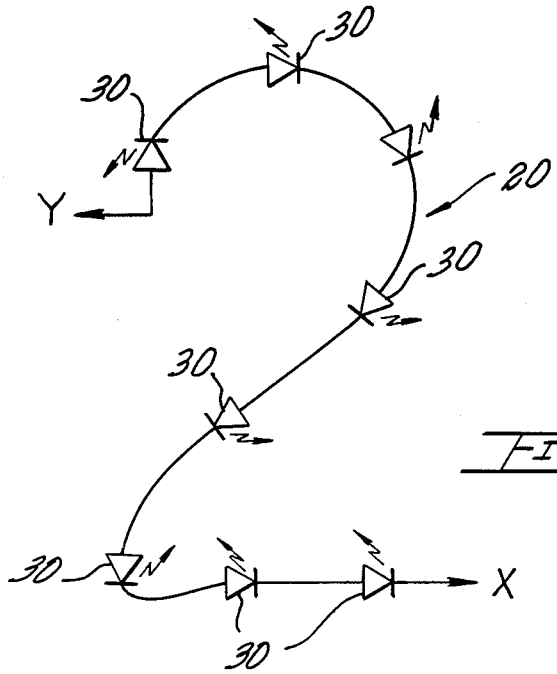
FIG. 4 is a schematic representation of the electrical circuit of the light emitting diodes (LED's) used to illuminate the numerals of the present invention.

Referring now to FIG. 1, where it can be seen that the output of transformer T is connected to annunciator device A and the circuit is interruptable by virtue of normally open momentary switch S in series with the latter. Points of connection X and Y provide a source of a low alternating voltage (typically between 10 and 16 volts) alternating that is applied to LED circuit 20, as shown in FIGS. 1 and 4. Preferably, eight LED members 30 are used in series thereby providing the necessary voltage drop for each one of them with a minimum consumption of power.

Figure 2:
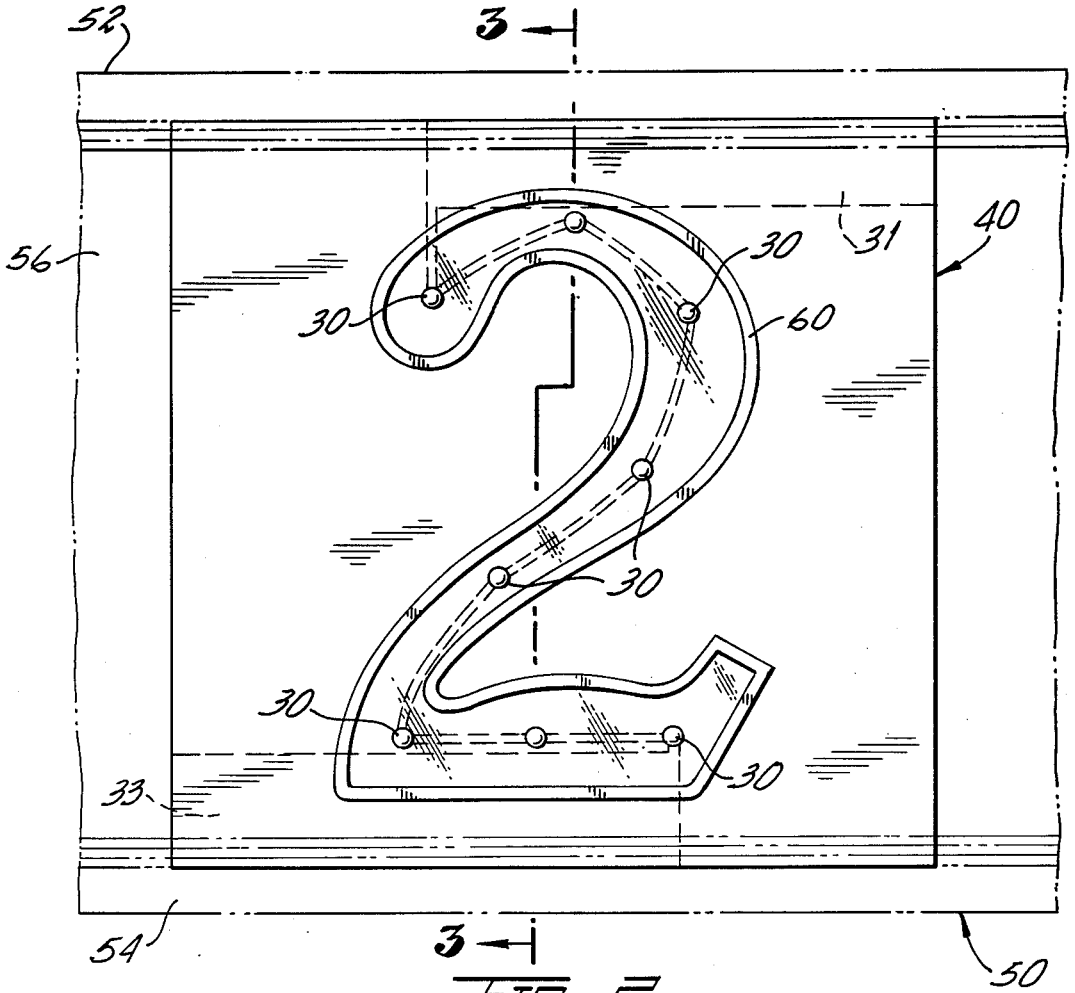
FIG. 2 shows a front elevational view of a numeral member mounted on a connecting bracket.
Figure 3:
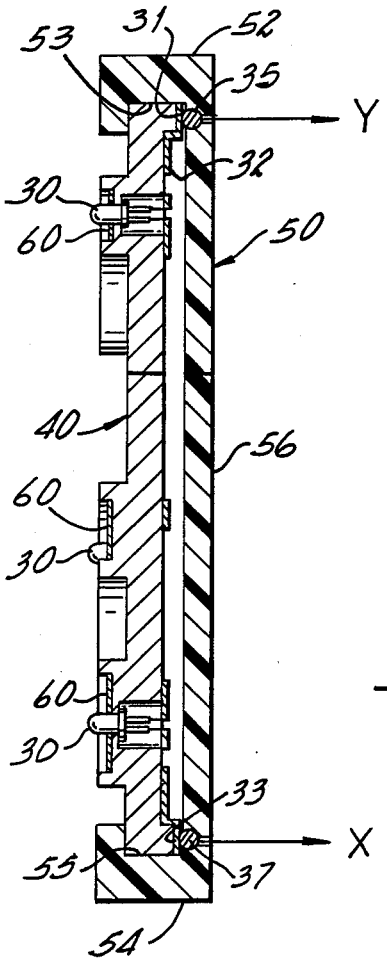
FIG. 3 illustrates a cross-sectional view taken along line 3—3 in FIG. 2.

As it can be best seen in FIGS. 2 and 3, numeral members 40 are removably mounted on electrically powered bracket 50 so that the former can be slidably mounted between upper and lower guide members 52 and 54. These guide members include channels 53 and 55 that cooperatively and slidably receive numeral member 40. LED members 30 are positioned to follow the contour of the numeral being represented. As it can be best seen in FIG. 3, upper and lower guide members 52 and 54 are separated by backing members 56 a suitable distance to allow for a snug fit of numeral member 40. It is to be understood that numeral 40 could also be a letter or any other aesthetic or informative symbol. Metallized connections 32 interconnect, preferably in series, the different LED members 30 and are powered by connection points X and Y.

Numeral members 40 can be removed at leisure to be cleaned or replaced with other ornamental symbols, numerals or letters to keep up with the seasons or to convey any desired message.

In the preferred embodiment shown in FIGS. 2 and 3, numeral member 40 includes contact pads 31 and 33 that come in electrical contact with electrodes 35 and 37, respectively. Pads 31 and 33 have an L shape so that numeral member 40 can be slid in bracket assembly 50 when the latter is horizontally disposed, as shown in FIGS. 2 and 3, or when it is vertically disposed.

A reflector member 60 having a reflective or shiny surface is preferably mounted on the front of numeral member 40. Reflector member 60 adopts the shape of the symbol, numeral or letter bring displayed.

Figure 5:
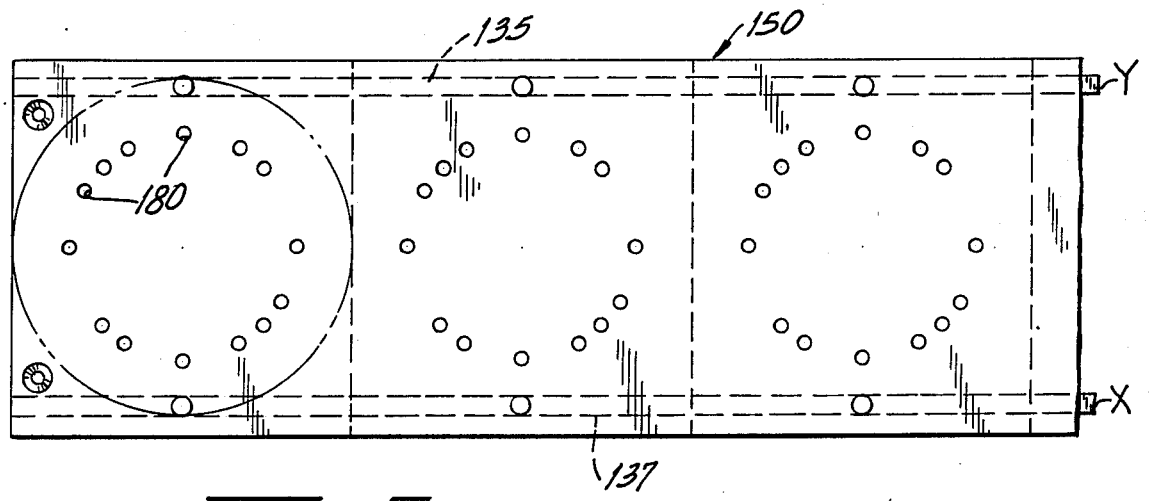
FIG. 5 shows an alternate embodiment for the present invention where the bracket may be positioned at a number of predetermined angles.
Figure 6:
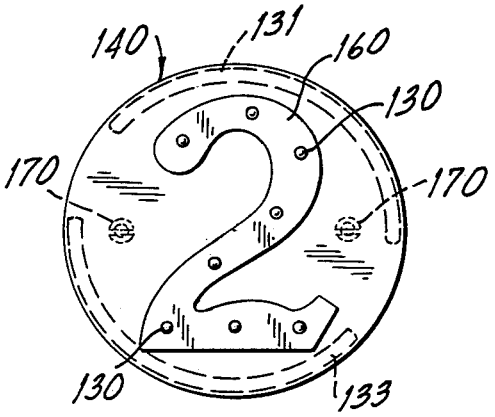
FIG. 6 represents a front view of an alphanumeric character.
Figure 7:
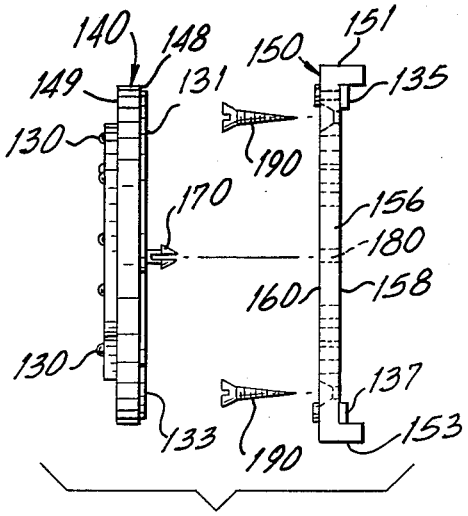
FIG. 7 is a side view of an alphanumeric member and a supporting bracket member showing the mounting structure.

An alternate embodiment for an illuminated house number device is illustrated in FIGS. 5 through 8. In FIG. 5 the electrically powered bracket 150 (a three alphanumeric bracket is shown) includes electrodes 135 and 137 that are electrically connected to points X and Y shown in FIG. 1. Backing member 156 is substantially a flat piece with an elongated rectangular shape with back and front surfaces 158 and 160, respectively, as best shown in FIG. 7. Legs 151 and 153 separate back surface 158 and metallized electrodes 135 and 137 front coming in direct contact with the surface where bracket 150 is mounted.

Figure 8:
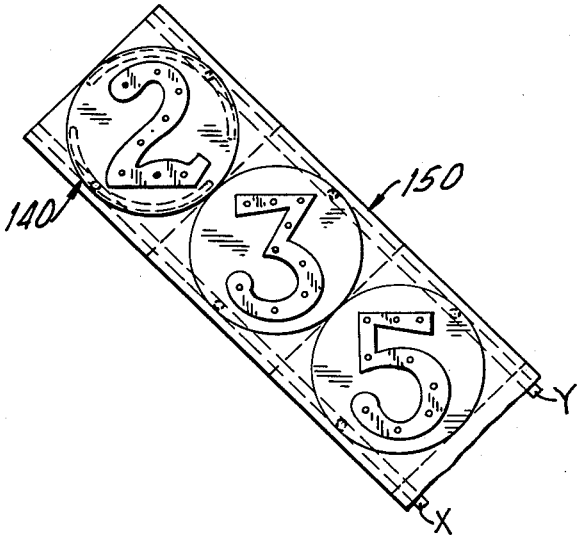
FIG. 8 shows an inclined panel with vertical or upright alphanumeric members mounted thereon.

Round numeral members 140 have also back and front surfaces 148 and 149. Round, numeral member 140 removably mounts over front surface 168 through, preferably, bifurcated rivets 170 that are pushed through cooperating opening 180. The contour of an alphanumeric character is preferably raised over front surface 149 and it is provided with several LED members 130 connected in series. A reflector member 160 is mounted on the front of the raised alphanumeric character. Several through apertures 180 are provided on bracket member 150 that cooperatively receive connecting rivets 170 so that numeral members 140 may be positioned upright even though bracket member 150 may be inclined, as best seen in FIG. 8. Round numeral member 140 includes conducting pads 131 and 133 that come in contact with electrodes 135 and 137, respectively and independently of the relative position of numeral member 140. Screw member 190 are used to affix bracket member 150 to a supporting wall (not shown). Legs 151 and 153 keep undersurface 158 separated from the supporting wall (not shown where it would be mounted.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense.

What is claimed is:

1. A device for illuminating numbers being connected to the contacts of a normally open momentary switch of a doorbell, comprising:

A. an elongated and flat bracket assembly having two electrodes mounted thereon, said electrodes being respectively connected to each one of said contacts and include each an elongated conductor longitudinally extending along said bracket assembly and being disposed in a spaced apart relationship so that the connection to the respective of said circuit is facilitated;

B. a plurality of symbol assemblies having substantially a square shape and a back surface and removably mounted to said bracket assembly and each one of said symbol assemblies including a circuit comprising a plurality of LED members connected in series and said circuit having two ends that are each connected to said electrodes and said LED members define a predetermined symbol and further includes reflective means following said defined symbol contour so that the display of said symbol is thereby enhanced, and said symbol assemblies further including two contact pads mounted on said back surface and connected electrically to said circuit ends and said pads being slidably connected to said electrodes and said pads being positioned on opposite corners so that said symbol assemblies can be arranged vertically or horizontally to display said symbols while maintaining the electrical contact between said pads and said electrodes.

2. The device set forth in claim 1 wherein said symbol assemblies have a round shape and include each at least two rivet means for removably mounting said symbol assemblies on said bracket assembly and said bracket assembly including a plurality of through apertures disposed at predetermined locations on said bracket assembly to cooperatively receive said rivet means so that said symbol can be mounted in an upright position regardless of the position of said bracket assembly.

3. The device set forth in claim 2 wherein said LED members define a predetermined symbol and further including reflective means following said defined symbol contour so that the display of said symbol is thereby enhanced.

4. The device set forth in claim 3 wherein said electrodes include each an elongated conductor longitudinally extending along said bracket assembly and being disposed in a spaced apart relationship so that the connection to the respective ends of said circuit is facilitated.

5. A device for illuminating numbers being connected to the contacts of a normally open momentary switch of a doorbell, comprising:

A. an elongated and flat bracket assembly having two electrodes mounted thereon and said electrodes being respectively connected to each one of said contacts and said bracket assembly further including a plurality of through apertures;

B. a plurality of round symbol assemblies removably mounted to said bracket assembly and one of said symbol assemblies including a circuit comprising of plurality of LED members connected in series and said circuit having two ends that are each connected to said electrodes and said round symbol assemblies including at least two pins that cooperatively engage with said apertures so that said symbol assemblies may be positioned at a number of predetermined angles with respect to said bracket assembly.

6. The device set forth in claim 5, wherein said symbol assemblies include two contact pads mounted on a back surface thereof and connected electrically to said circuit ends and said pads being connected to each one of said electrodes.

* * * * *